US006252185B1

(12) United States Patent
Shibata et al.

(10) Patent No.: US 6,252,185 B1
(45) Date of Patent: Jun. 26, 2001

(54) DELAY SWITCH WITH DELAY UNIT

(75) Inventors: Kiwamu Shibata, Kyoto; Hideya Kondo, Osaka; Takaaki Chuzawa, Osaka; Jun Saito, Osaka; Nobuhiro Kitamura, Osaka; Tetsuyasu Kawamoto, Osaka; Satoshi Kajiyama, Osaka; Takeshi Ono, Osaka, all of (JP)

(73) Assignee: Matsushita Electric Works, Ltd., Osaka (JP)

( * ) Notice: Subject to any disclaimer, the term of this patent is extended or adjusted under 35 U.S.C. 154(b) by 0 days.

(21) Appl. No.: 09/584,150

(22) Filed: May 31, 2000

Related U.S. Application Data

(63) Continuation of application No. 09/048,165, filed on Mar. 26, 1998, now abandoned.

(30) Foreign Application Priority Data

Oct. 28, 1997 (JP) ..... 9-294750

(51) Int. Cl.[7] ..... H01H 7/03
(52) U.S. Cl. ..... 200/34
(58) Field of Search ..... 200/34, 33 R, 200/302.1; 968/801; 267/114

(56) References Cited

U.S. PATENT DOCUMENTS

| | | | | |
|---|---|---|---|---|
| 1,995,721 | * | 3/1935 | Sanford | 968/801 |
| 2,488,024 | | 11/1949 | Mudon | 200/34 |
| 2,800,538 | * | 7/1957 | Kuhn | 200/34 |
| 3,000,034 | | 9/1961 | Webb | 200/34 |
| 3,484,090 | * | 12/1969 | Mahoney | 267/114 |
| 3,495,342 | | 2/1970 | Goldstein | 200/34 |
| 4,638,128 | | 1/1987 | Kuwabara et al. | 200/33 R |

FOREIGN PATENT DOCUMENTS

| | | |
|---|---|---|
| 1 252 141 | 8/1985 | (CA) . |
| 61-55825 | 3/1986 | (JP) . |

* cited by examiner

*Primary Examiner*—Renee Luebke
(74) *Attorney, Agent, or Firm*—Sughrue, Mion, Zinn, Macpeak & Seas, PLLC

(57) ABSTRACT

In the setting operation conducted by the handle 90 which is an operating section, an upper portion of the portion 26*a*' of the slidable T-post 26 is pushed by the end portion of the cam 90*b*, and the slidable T-post 26 is moved. In accordance with the movement of the card 26, the suction cup block 23 is elastically deformed, and the suction cup 23*b* is held by the body 24 by a holding force of the suction cup 23*b*. The body 24 is composed of a porous body, and air flows from the ventilation hole 29 into a space formed between the suction cup 23*b* and the body 24, via the body 24. The slidable T-post 26 is biased ahead by the return spring 27. When the releasing operation is conducted by the handle 90, the cam 90*b* is rotated, and the end portion of the cam 90*b* is separated from the end of the portion 26*a*' to be pushed. After that, when the intensity of the holding force of the suction cup 23*b* to the body 24 is decreased lower than that of the spring force of the return spring 27, the slidable T-post 26 is moved ahead, so that the card member 26*c* pushes up the movable contactor 70.

19 Claims, 10 Drawing Sheets

DELAY SWITCH WITH DELAY UNIT

This is a Continuation of application Ser. No. 09/048,165 filed Mar. 26, 1998 and now abandoned, the disclosure of which is incorporated herein by reference.

BACKGROUND OF THE INVENTION

1. Field of the Invention

The present invention relates to a delay switch in which the switching motion is delayed for a predetermined period of time.

2. Related Art

Concerning this type delay switch, for example, a delay switch used for a ventilation fan and an illuminating light installed in a toilet is well known as disclosed in Japanese Unexamined Patent Publication No. 61-55825. This conventional delay switch has a control function (delay function) in which the ventilation fan and the illuminating light are respectively turned on by the operation of a handle which is an operating section, the illuminating light is turned off by the next handle operation, and the ventilation fan is turned off after a predetermined period of time has passed which is determined by a delay unit.

However, in the conventional structure described above, the following problems may be encountered. The structure of the delay unit (delay element) to determine the above predetermined period of time is complicated and the manufacturing cost is high; the feeling of operation is not good because the handle operation is linked with a gear of the delay unit; and various noises are caused by the delay function of the delay unit.

SUMMARY OF THE INVENTION

The present invention has been accomplished in view of the above circumstances. It is an object of the present invention to provide a delay switch, the manufacturing cost of which is low, the reliability of which is high, and the intensity of noise generated by the delay switch is low.

In order to accomplish the above object, the present invention is to provide a delay switch comprising: an operating section; a suction cup linked with the setting operation conducted by the operating section; a slidable T-post to open and close the switching mechanism being linked with the suction cup; a body to hold the suction cup after the suction cup has been moved; a return spring to give a force to the suction cup in a direction so that the suction cup can be separated from the body; and a terminal with which the switching mechanism is electrically connected, wherein a delay time is caused from the time at which releasing operation is conducted in the operating section to the time at which the suction cup is separated from the body, in accordance with a balance between the holding force of the suction cup to the body and the spring force of the return spring. Since the delay time is determined by a balance between the holding force of the suction cup to the body and the spring force of the return spring, no gears are required unlike the conventional delay unit, and structure of this delay switch is simpler than that of the delay switch having the conventional delay unit, and further the reliability is high and the manufacturing cost can be reduced and the noise can be decreased. Unlike the conventional delay switch, no gears are required in the delay switch. Therefore, the operation conducted in the operating section is smooth.

According to the present invention, in the structure of the delay switch, a delay unit is composed of the suction cup, the body, the slidable T-post and the return spring. Accordingly, compared with the conventional delay switch, the manufacturing cost of the delay unit can be reduced, and further the delay switch can be miniaturized. Furthermore, the intensity of noise generated by the delay switch can be decreased.

According to the present invention, in the structure of the delay switch, a case for the element in which at least the suction cup and the body are accommodated. Therefore, it is possible to prevent foreign objects such as dust from intruding into a space between the suction cup and the body, by the case for the element. Accordingly, the suction cup can be stably held to the body, and the delay time can be kept substantially constant.

According to the present invention, in the structure of the delay switch, a dust protection means separates the suction cup from the outside of the case for the element. Therefore, it is possible to prevent foreign objects such as dust from intruding into a space between the suction cup and the body. Accordingly, the suction cup can be stably held to the body, and the delay time can be kept substantially constant.

According to the present invention, in the structure of the delay switch, the dust protection means is an elastic suction cup cover accommodated in the case for the element and linked with the slidable T-post. Since the structure of the dust protection means is simple, the motion of the suction cup is not obstructed by the dust protection means, and it is possible to prevent foreign objects such as dust from intruding into a space between the suction cup and the body.

According to the present invention, in the structure of the delay switch, wherein the body is a porous body. Accordingly, the delay time can be easily set. Further, compared with an unporous body, the coefficient of air transmission of the unporous body is seldom affected by the temperature. Therefore, a variation of the delay time caused by a variation of the ambient temperature can be reduced, and the delay time can be controlled with high accuracy.

According to the present invention, in the structure of the delay switch, the slidable T-post is composed of a slidable T-post member to open and close the switch mechanism and a drive shaft member to hold the suction cup to the body, and the slidable T-post member and drive shaft member are uniformly formed. Therefore, the number of parts can be reduced and the manufacturing process can be simplified. Accordingly, the manufacturing cost can be decreased.

According to the present invention, in the structure of the delay switch, the slidable T-post is composed of a card member to open and close the switch mechanism and a drive shaft member to hold the suction cup by the body, and the slidable T-post member and the drive shaft member are combined with each other. Therefore, the profile of the slidable T-post can be easily controlled.

According to the present invention, in the structure of the delay switch, a case in which at least the suction cup, body, slidable T-post and return spring are accommodated, wherein this case is composed by a size corresponding to one set of embedded type wiring accessory, the unit size of which is determined so that three sets of wiring accessories can be attached at maximum in such a manner that the front surface of the case is exposed from an opening window of the attaching frame of the embedded type wiring accessories. Accordingly, it is possible to attach the delay switch to the attaching frame in the same manner as that of the embedded type wiring accessories such as a receptacle and a switch. Therefore, the attaching work can be performed easily.

According to the present invention, in the structure of the delay switch, the terminal is composed of a quick-connecting type terminal structure including a terminal plate to which an electrical wire is connected, a lock spring to connect the electrical wire to the terminal plate with pressure, and a release button to bend the lock spring in the release direction so as to disconnect the electrical wire from the terminal plate. Therefore, compared with a screw type terminal structure, the attaching work can be conducted safely. Further, since the electrical wire can be easily and positively connected to the terminal, wiring can be conducted uniformly, and the labor and time can be saved in the attaching work.

BRIEF DESCRIPTION OF THE DRAWINGS

FIG. 1(*a*) is a plan view showing a state in which the delay switch is turned on, and FIG. 1(*b*) is a cross-sectional view showing a state in which the delay switch is turned on;

FIG. 2 is a cross-sectional side view showing the above embodiment in a state in which the delay switch is turned on;

DETAILED DESCRIPTION OF THE PREFERRED EMBODIMENTS

Referring to FIGS. 1 to 10, an embodiment of the present invention will be explained below.

As shown in FIGS. 1 to 4, the case 1 of the delay switch of this embodiment is composed in such a manner that the body 10 made of synthetic resin and the cover 80 made of synthetic resin are combined with each other by a pair of substantially C-shaped clamps 40.

Figure 4:
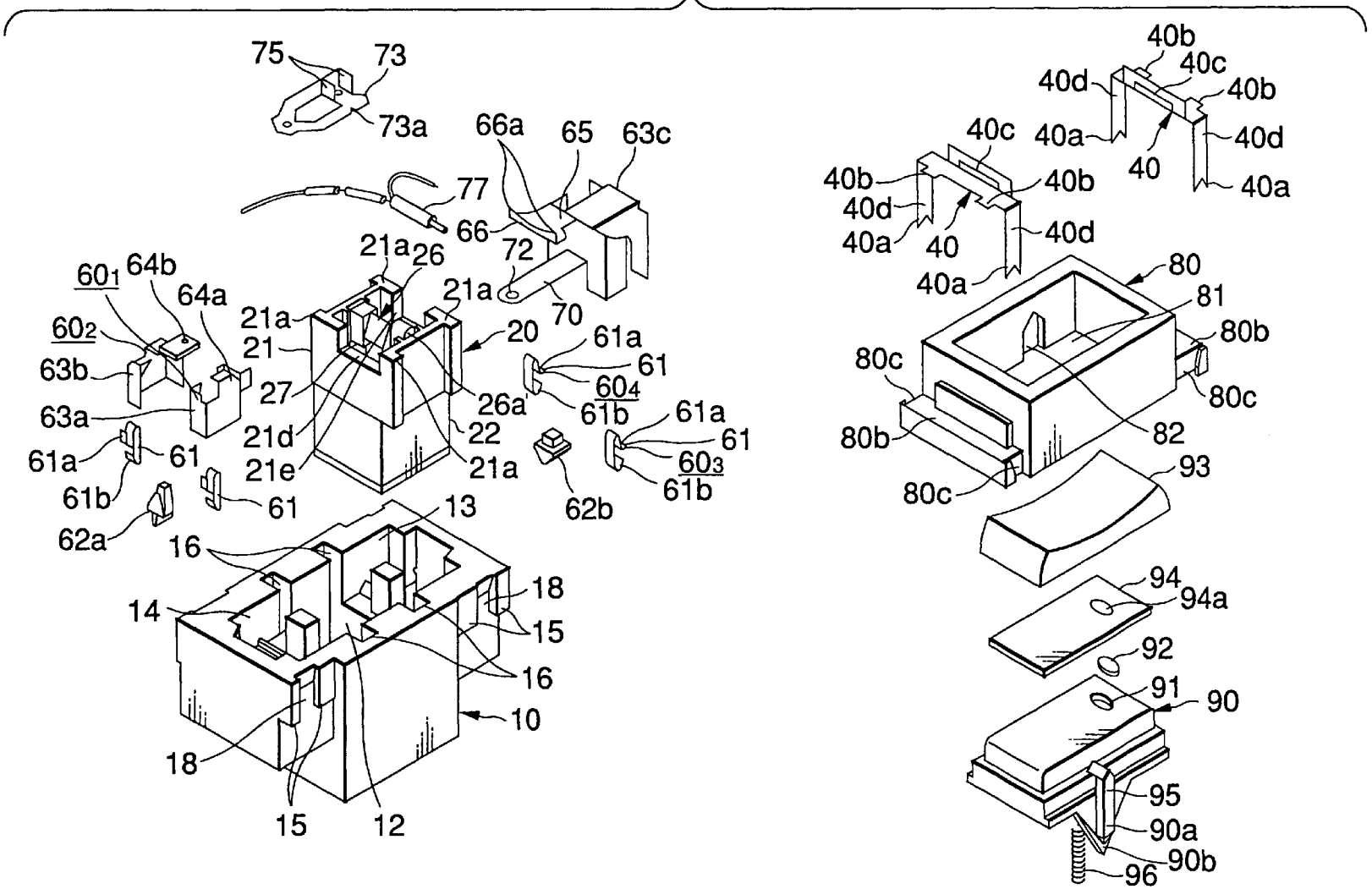
FIG. 4 is an exploded perspective view showing the above embodiment.
Figure 5:
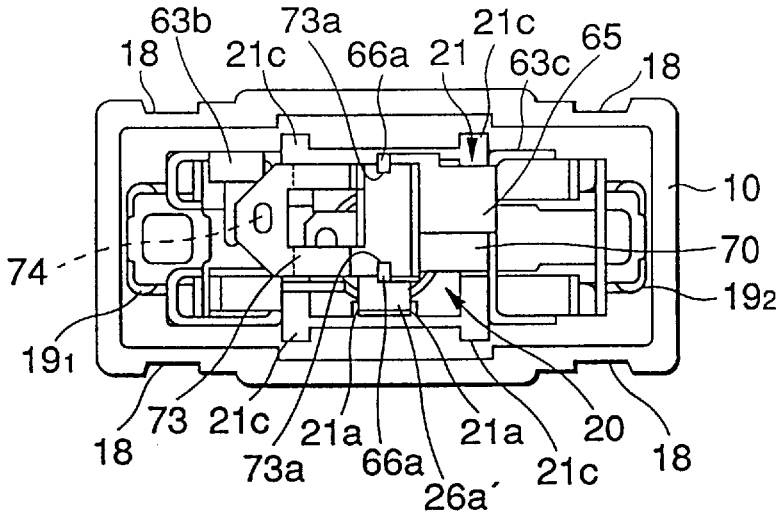
FIG. 5 is a plan view showing a state in which the handle and cover are removed from the above delay switch.
Figure 6:
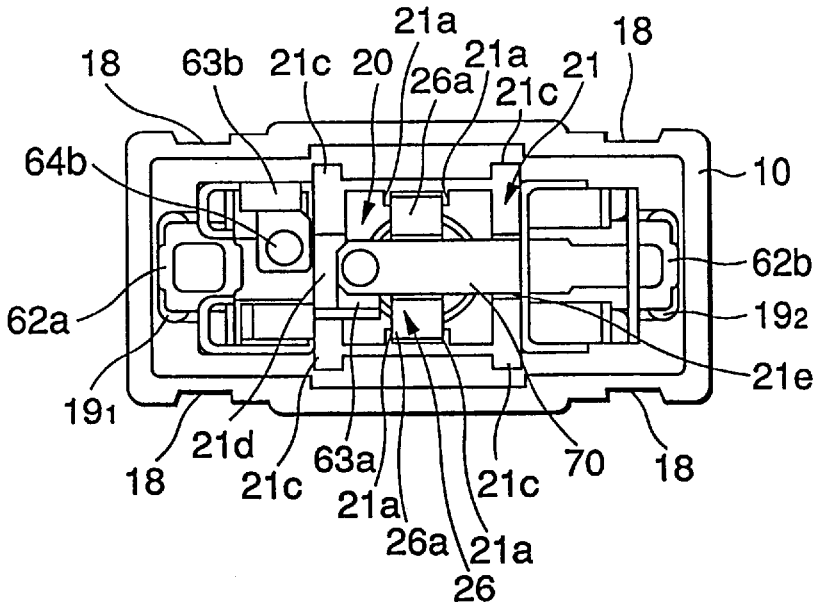
FIG. 6 is a plan view showing a primary portion of FIG. 5, in which the locking member is removed from the above delay switch.

As shown in FIG. 4, there are provided shoulder portions 80*b* at both end portions of the cover 80. On the side of each shoulder portion 80*b*, there is formed a recess 80*c* into which the leg piece 40*d* of the clamp 40 is inserted. On the other hand, on the front end side of the body 10, at a position corresponding to the recess 80*c*, there is provided a recess 18 into which the leg piece 40*d* of the clamp 40 is inserted. Accordingly, the body 10 is combined with the cover 80 as follows. The clamp 40 is inserted from the front surface side of each shoulder portion 80*b* of the cover 80, that is, the leg piece 40*d* of the clamp 40 is inserted into the recess 80*c* of the cover 80 and the recess 18 of the body 10. When the substantially V-shaped hooking claws 40*a* formed at the end portions of both leg pieces 40*d* of the clamp 40 are engaged with the step portion 15 formed on the side of the body 10, the cover 80 and the body 10 are fixed to each other by the clamp 40.

Figure 10:
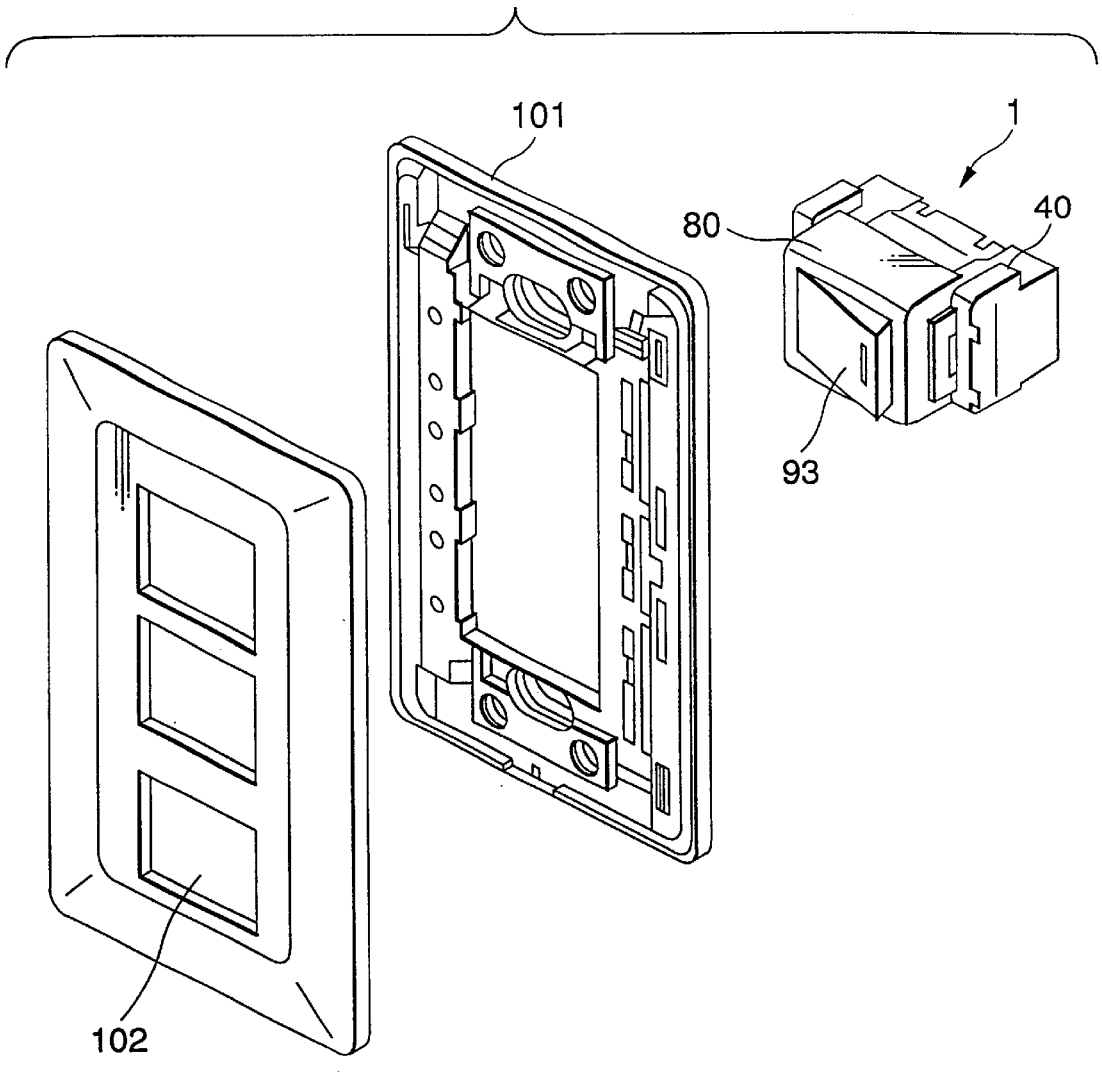
FIG. 10 is an exploded perspective view of the delay switch of the present invention accommodated with the attaching frame.

As shown in FIG. 10, the case 1 has of a size corresponding to one set of an embedded type wiring accessory, the unit size of which is determined so that three sets of the wiring accessories can be attached at maximum in such a manner that the front surface of the case 1 is exposed from a window opening 102 of the attaching frame 101 of the embedded type wiring accessories. For example, the size-of the case 1 corresponds to the size of one set of the wiring accessory, the unit size of which is determined so that three sets of wiring accessories can be attached at maximum to an attaching frame of the wiring accessory standardized by Japanese Industrial Standard (JIS) (for example, JIS C 8375, or JIS C 8316). A pair of engaging claws 40*b* capable of engaging with the attaching holes formed in the attaching frame are protruded from both end portions of the clamp 40. In each clamp 40, there is provided an engaging hole 40*c* with which the engaging claw of the attaching frame is engaged when the assembling frame is attached to the attaching frame made of metal.

On the cover 80, there is formed an opening portion 81 in which the handle 90 is accommodated in such a manner that a portion of the operation handle 90 is protruded from the front surface of the case 1. Inside the cover 80, there are formed recesses 82 which are engaged with the protrusions 95 protruded from both sides of the handle 90. Accordingly, when the handle 90 is accommodated in the opening portion 81, the protrusions 95 on both sides of the handle 90 are respectively inserted into and engaged with the recesses 82, so that the recesses 82 of the cover 80 can be used as fulcrums of the handle when the handle is oscillated.

On the other hand, in the side end portions on the rear side of the handle 90, a pair of substantially triangular guide pieces 90*a* (shown in FIGS. 2 and 4) are protruded. The handle 90 has a substantially triangular cam 90*b* (shown in FIGS. 1(*b*), 2 and 3) which is protruded backward from the rear surface of the handle 90 in a portion inside the guide piece 90*a*. Handle 90, guide piece 90*a* and cam 90*b* constitute one embodiment of an operating section. In this case, an end portion of the cam 90*b* comes into contact with an end portion of the portion to be pushed provided in the slidable T-post 26. In the front portion of the handle 90, there is provided a transparent name cover 93. In this connection, there is interposed a name sheet 94 between the name cover 93 and the handle 90.

On the front surface of the handle 90, there is formed a light transmitting window 91. A light transmitting member 92 made of a light transmitting material is attached to the light transmitting window 91. In this connection, there is formed a hole 94*a* on the name sheet 94 at a position opposed to the light transmitting window 91 of the handle 90.

Figure 1A:
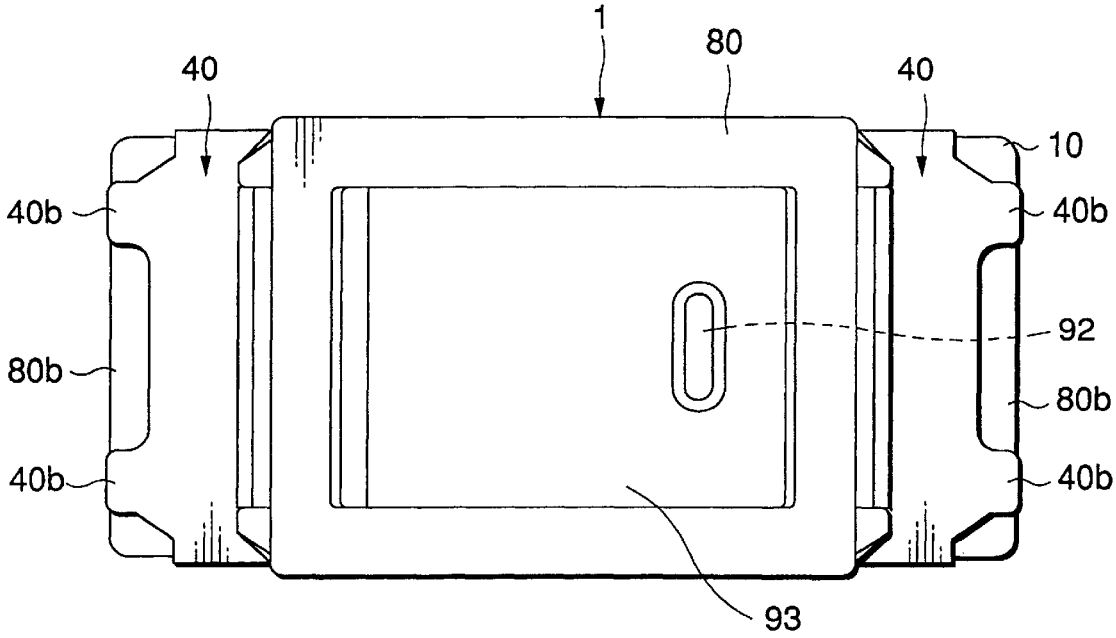
FIGS. 1(*a*) and 1(*b*) are views showing an embodiment.
Figure 1B:
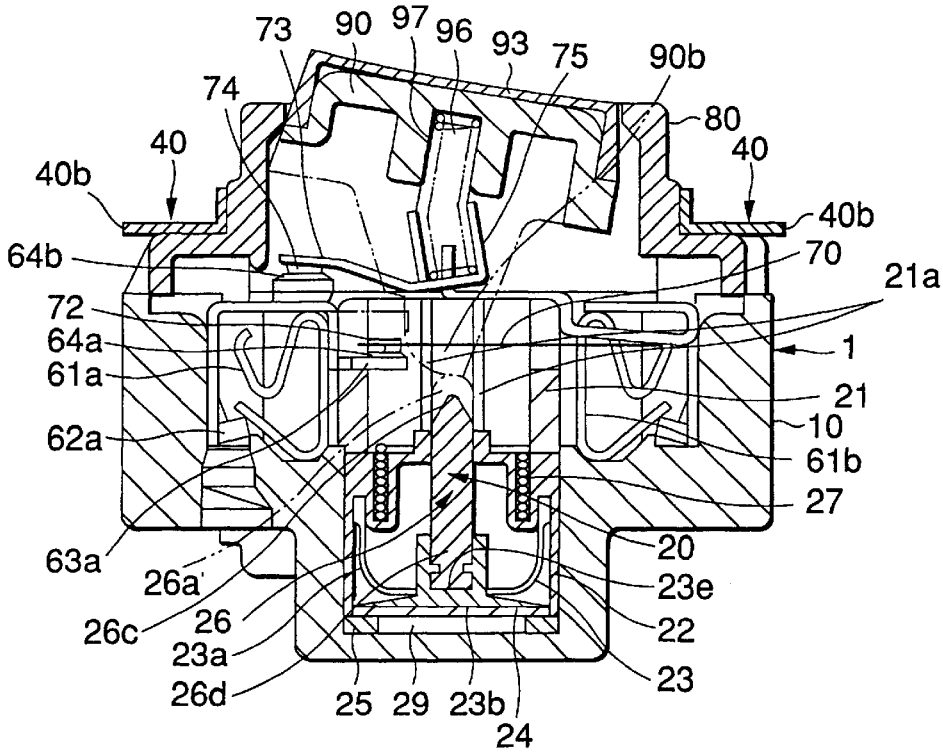

In this connection, on the rear side of the handle 90, there is formed a recess 97 (shown in FIGS. 1(*b*) and 2) into which one end side of the compression spring 96 is inserted. The other end side of the compression spring 96 is supported by the spring supporting section 75 of the rocking member 73. The rocking member 73 can be inclined in a direction opposite to the inclining direction of the handle 90 by the action of the compression spring 96. At the end point of oscillation of the handle 90, the compression spring 96 is curved into a C-shape or a reverse C-shape. Therefore, a restoring force is generated by the compression spring 96 so that the compression spring 96 can be returned to the initial straight condition. Due to the above restoring force, the handle 90 can be positively fixed at the position.

As shown in FIG. 4, at the substantial center of the body 10, there is provided a delay unit accommodating section 12. On both sides of the delay unit accommodating section 12, there are provided terminal accommodating sections 14, 13. In the delay unit accommodating section 12, a delay unit 20 is accommodated. In the terminal accommodating section 14, terminals 601, 602 are accommodated, which will be described later. In the terminal accommodating section 13, terminals 603, 604 are accommodated which will be described later.

The delay unit 20 will be explained below.

Figure 8:
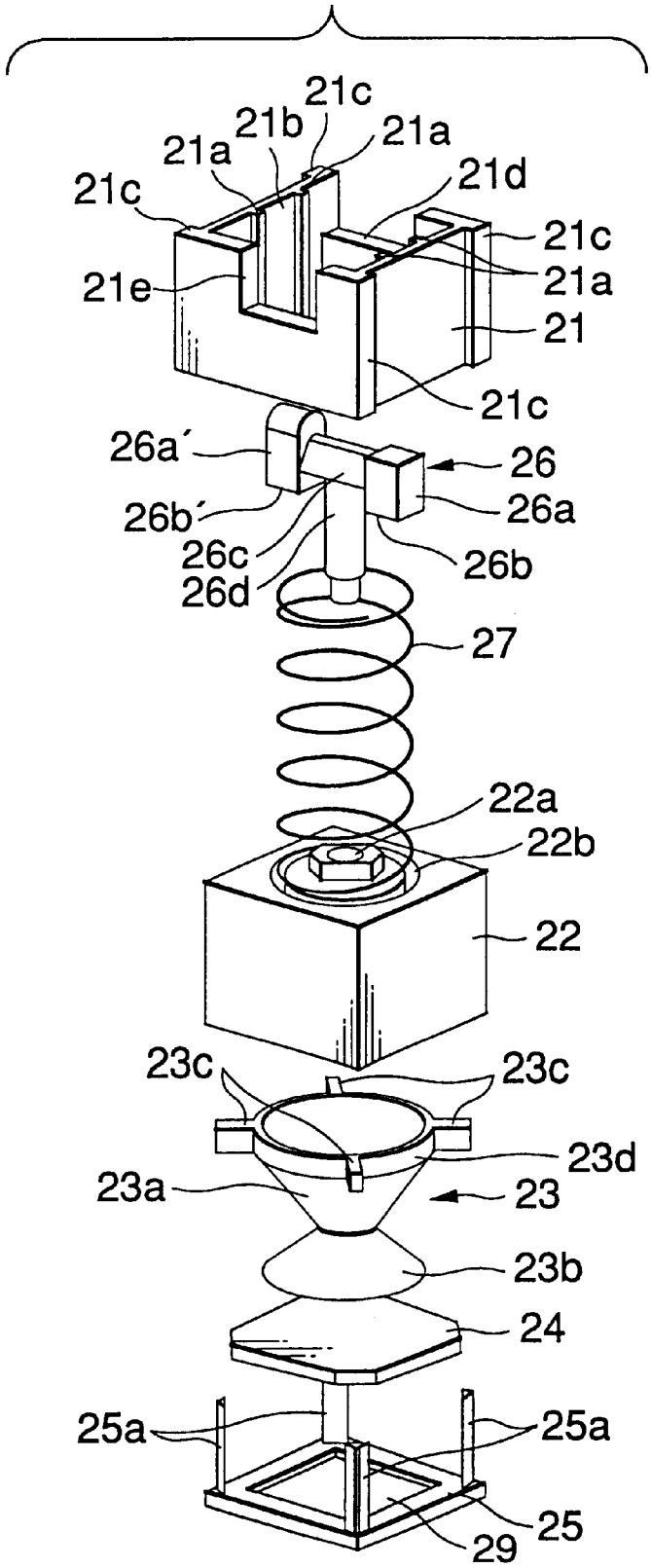
FIG. 8 is an exploded perspective view of the delay switch used in the above embodiment, wherein the view is taken from the front side.
Figure 9:
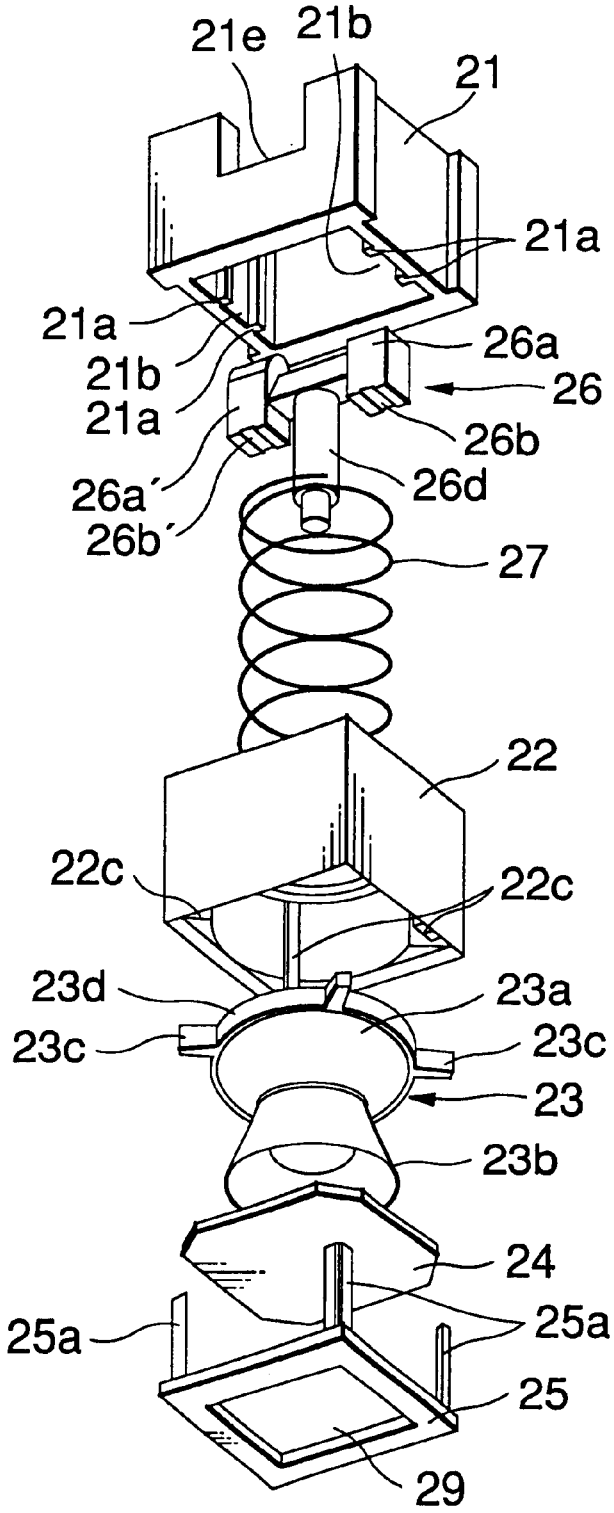
FIG. 9 is an exploded perspective view of the delay switch used in the above embodiment, wherein the view is taken from the rear side.

As shown in FIGS. 8 and 9, the delay unit 20 includes: a substantially T-shaped post (slidable T-post) 26; a frame 21 made of thermo-setting resin in which the groove 21*b* is formed to guide the pushing portion 26*a* and the portion 26*a*' to be pushed when the slidable T-post 26 is moved (the groove 21*b* is a groove formed between a pair of ribs 21*a* shown in FIG. 8); a return spring 27 composed of a coil spring to bias the slidable T-post 26 ahead, that is, to bias the slidable T-post 26 upward in FIG. 1(*b*); a suction cup block 23 made of silicon rubber or vinyl chloride which can be elastically deformed; a body 24 in the shape of a rectangular plate, composed of a porous material (for example, a porous ceramic material), having an air transmitting property, to which the suction cup 23*b* of the suction cup block 23 is held by a holding force due to the suction of cup 23*b*; a box-shaped case 22 used for the element in which the suction cup block 23 and the body 24 are accommodated, wherein a rear surface of this box-shaped case 22 is open; and a lower frame 25, at the center of which the ventilation window 29 is open, combined with the rear opening of the case 22 used for the element. In this connection, the suction cup block 23 is composed of the suction cup 23*b* and the suction cup cover 23*a* made of the same material as that of the suction cup 23*b*, and the suction cup cover 23*a* is integrated with the suction cup 23*b*. Due to the above arrangement of this embodiment, the suction cup cover 23*a* divides the suction cup 23*b* and the outside of the case 22 used for the element. Accordingly, it is possible to substantially prevent foreign objects such as dust from entering a space between the suction cup 23*b* and the body 24. Therefore, the body 24 can be stably held by the holding force of the suction cup 23*b*, and the delay time can be kept substantially constant. In this case, the suction cover 23*a* composes a dust protecting means, and the suction cup 23*b* and the suction cup cover 23*a* are formed integrally with each other. Therefore, the manufacturing cost can be reduced. In this connection, the suction cup 23*b* is biased by the return spring 27 via the slidable T-post 26.

Figure 7:
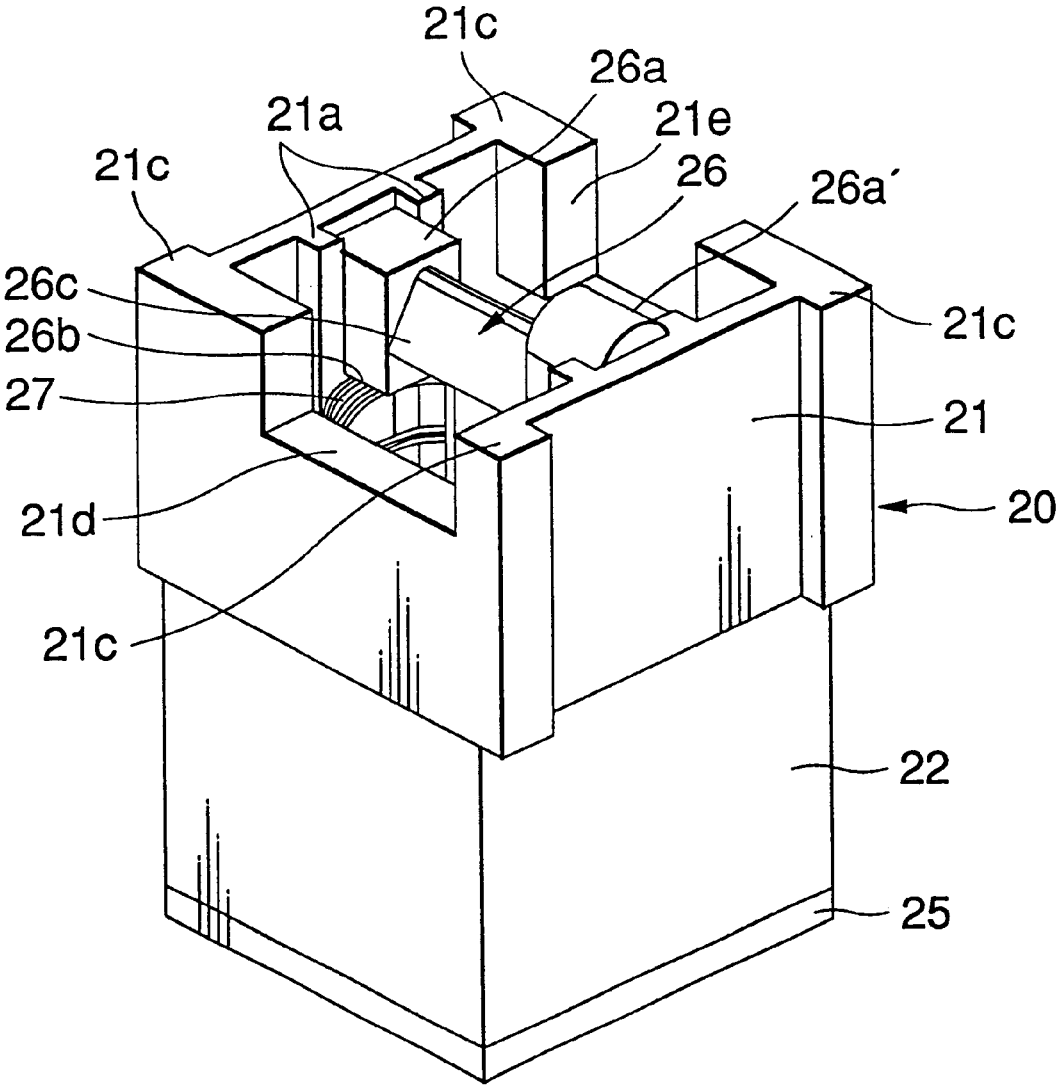
FIG. 7 is a perspective view of the delay unit used in the above embodiment.

As described before, the frame 21 is made of thermo-setting resin. As shown in FIG. 7, the frame 21 has a pair of protrusions 21*c* used for positioning on each side, by which the frame 21 can be positioned with respect to the body 10, wherein these protrusions 21*c* used for positioning are extended from the front end to the rear end. On the other hand, as shown in FIG. 4, the positioning grooves 16 to guide the above protrusions 21*c* used for positioning are formed on the inner surfaces of the delay unit accommodating section 12 in the body 10. Since the frame 21 is made of thermo-setting resin in this embodiment, heat is difficult to be transmitted from the terminals $\mathbf{60}_1$ to $\mathbf{60}_4$ to the delay unit 21 and other components. Since the frame 21 is arranged in this embodiment, a force given by the terminals $\mathbf{60}_1$ to $\mathbf{60}_4$ is seldom transmitted to other components. Therefore, the reliability is high in the operation.

In the lower frame 25, protruding pieces 25*a* are protruded ahead at positions close to the four corners. After the suction cup block 23 and the body 24 are accommodated in the case 22 for the element, the protruding pieces 25*a* are inserted into the grooves 22*c* formed on the inner side surfaces of the case 22 for the element. In this way, the lower frame 25 is combined with the case 22 for the material. In the suction cup block 23, there is provided a flange portion 23*d* at the front edge portion of the suction cup cover 23*a*, and also there are provided protruding pieces 23*c* which protrude laterally from the flange portion 23*d*. These protruding pieces 23*c* are inserted into the above grooves 22*c*, so that the suction cup block 23 can be fixed to the case 22 for the element. The body 24 is arranged in such a manner that the outer circumferential portion comes into contact with the inner side surfaces of the case 22 at the rear of the case 22, so that the body 24 is held and fixed by the lower frame 25.

On the front surface of the case 22 for the element, there is provided an insertion hole 22*a* into which the drive shaft 26*d* of the card 26 is inserted, and also there is provided a spring receiving groove 22*b* with which an end portion of the return spring 27 is engaged, and this spring receiving groove 22*b* is formed outside the periphery of the insertion hole 22*a* in such a manner that the insertion hole 22*a* is surrounded by the spring receiving groove 22*b*. On the other hand, on the rear surfaces of the portion 26*a*' to be pushed and the pushing portion 26*a* of the slidable T-post 26, there are respectively formed spring receiving grooves 26*b*', 26*b* by which a portion of the other end portion of the return spring 27 is held.

Further, the suction cup 23*b* is formed in a cup-like shape and arranged to a drive shaft 26*d* (drive shaft member), so that when the suction cup passes through the insertion hole 22, the suction cup 23*b* forms a sealing space between the suction cup 23*b* and the body 24 to prevent dust from entering the sealing space.

The slidable T-post 26 is capable of sliding in the guide groove 21*b* formed on the inner side surface of the frame 21. An end portion of the drive shaft 26*d* of the slidable T-post 26 is fixed to the recess 23*e* formed on the bottom surface of the suction cup cover 23*a* by means of press-fitting. Due to the above arrangement, profiles of the suction cup cover 23*a* and the suction cup 23*b* are changed in accordance with the movement of the slidable T-post 26 as shown in FIGS. 1(*b*) and 3. In this embodiment, the slidable T-post 26 includes: a card member 26*c*, at one end of which the portion 26*a*' to be pushed is formed, at the other end portion of which the pushing portion 26*a* is formed; and the drive shaft 26*d* (drive shaft member). The card member 26*c* and the drive shaft 26*d* are simultaneously formed. Therefore, the number of parts can be reduced, and the manufacturing process can be simplified. Accordingly, the manufacturing cost can be decreased. The card member 26*c* and the drive shaft 26*d* may be formed differently from each other. In this case, the profile of the slidable T-post 26 can be easily controlled.

In this connection, the delay unit 20 is composed in such a manner that air flows into a space formed between the suction cup 23*b* and the body 24, from the ventilation window 29 via the body 24 under the condition that the suction cup 23*b* is held to the body 24 by the holding force of the suction cup 23*b*. Accordingly, when an end portion of the cam 90*b* is separated from the end of the portion 26*a*' to be pushed, an intensity of the holding force of the suction cup 23*b* to the body 24 is gradually reduced. When the intensity of this holding force is reduced to be lower than the intensity of the restoring force of the restoring spring 27, the suction cup 23*b* is separated from the body 24. That is, the card 26 is moved ahead (upward in FIG. 1(*b*)) after some delay. That is, the slidable T-post 26 is moved ahead after a predetermined period of time (referred to as a delay time hereinafter) has passed from a point of time at which the end portion of the cam 90*b* has separated from the end of the pushing portion 26*a*'. Accordingly, when the coefficient of transmission of air of the body 24 is changed, where, the material of the suction cup 23*b* and the material of the body 24 are changed, it becomes possible to adjust the delay time. Since the body 24 is composed of a porous body made of porous ceramics in this embodiment, the coefficient of transmission of air is more independent from temperature and humidity than that of the porous body. Accordingly, a variation of the delay time can be produced even when the temperature and humidity are changed in the environment in which the delay switch is arranged. Since the suction cup 23*b* is made of silicon rubber or vinyl chloride in this embodiment, the manufacturing cost can be reduced, and processing can be easily conducted to form the profile. Accordingly, the delay switch can be miniaturized due to the type of materials used to manufacture this embodiment.

The terminals $\mathbf{60}_1$, $\mathbf{60}_2$ (shown in FIG. 4) are accommodated in the above terminal accommodating section 14. In this case, the terminal $\mathbf{60}_1$ is composed of a terminal plate 63*a* and a S-shaped locking spring 61. The S-shaped locking spring 61 includes: a lock piece 61*b* which bites into an electrical wire inserted into the first electrical wire inserting hole (not shown) on the rear wall of the body 10 between the terminal plate 63*a* and the S-shaped locking spring 61, so that the electrical wire is prevented from being drawn out; and a contact piece 61*a* elastically coming into contact with the electrical wire. Accordingly, when the electrical wire is inserted from the lock piece 61*b* side into between the S-shaped locking spring 61 and the terminal plate 63*b* via the first electrical wire inserting hole, the electrical wire is held between the terminal plate 63*a* and the contact piece 61*a* by the actions of spring forces of the contact piece 61*a* and the lock piece 61*b*. At the same time, the lock piece 61*b* bites into the electrical wire. Therefore, the electrical wire can not be drawn out. In the same manner, the terminal $\mathbf{60}_2$ is composed of a terminal plate 63*b* and a S-shaped locking spring 61. The electrical wire inserted into the second electrical wire inserting hole 172 (shown in FIG. 3) on the rear wall of the body 10 is held between the terminal plate 63*a* and the contact piece 61*a* by the actions of spring forces of the contact piece 61*a* and the lock piece 61*b*. In the terminal accommodating section 14, there is provided a release button 62*a* in such a manner that the release button 62*a* strides both lock springs 61. The release button 62*a* comes into contact with the lock pieces 61*b* of both lock springs 61. A portion in which the release button 62*a* comes into contact with the lock piece 61*b* is shifted form portions in which the lock pieces 61*b*, 61*b* hold the electrical wires between lock pieces 61*b*, 61*b* and the terminal plates 63*a*, 63*a*. In a portion corresponding to the release button 62*a* on the rear wall of the body 10, there is formed an operation hole 191 (shown in FIGS. 5 and 6). When an end of a minus drive is inserted into the operation hole $\mathbf{19}_1$ and the release button 62*a* is pushed by the driver, the lock pieces 61*b*, 61*b*, which have bitten into the electrical wire, are bent in the releasing direction, so that the electrical wire can be drawn out.

On the other hand, in the terminal accommodating section 13, there are accommodated a pair of terminals $\mathbf{60}_3$, $\mathbf{60}_4$ (shown in FIG. 4) composed of a quick terminal including the movable contact sideterminal plate 63*c* and a pair of lock springs 61. That is, the terminals $\mathbf{60}_3$ and $\mathbf{60}_4$ have the movable contact side terminal plate 63*c* in common. In the terminal $\mathbf{60}_3$, the electrical wire inserted into the third electrical wire inserting hole (not shown) on the rear wall of the body 10 is held between the movable contact side terminal plate 63*c* and the contact piece 61*a* by the spring forces of the contact piece 61*a* of the S-shaped locking spring 61 and the lock piece 61*b*, and the electrical wire inserted into the fourth electrical wire inserting hole (not shown) is held between the movable contact side terminal plate 63*c* and the contact piece 61*a* by the spring forces of the contact piece 61*a* of the S-shaped locking spring 61 and the lock piece 61*b*. In the terminal accommodating section 13, in the same manner as that of the terminal accommodating section 14, there is provided a release button 62*b* in such a manner that the release button 62*b* strides both lock springs 61, and there is provided an operation hole $\mathbf{19}_2$ (shown in FIGS. 5 and 6) on the rear wall of the body 10.

In this embodiment, the terminal accommodating section 14 and the terminal accommodating section 13 are arranged at both end portions of the case 1, that is, they are located being separated from each other. Therefore, the insulating property between the terminals $\mathbf{60}_1$, $\mathbf{60}_2$ and the terminals $\mathbf{60}_3$, $\mathbf{60}_4$ can be enhanced.

The aforementioned terminal plates 63*a*, 63*b* are respectively provided with different first fixed contact 64*a* and second fixed contact 64*b*, and different switch mechanisms are formed in the case 1. The aforementioned movable contact side terminal plate 63*c* is connected with a base end side of the rectangular movable contactor 70, at one end portion of which the first movable contact 72 is arranged. When the delay unit 20 is not provided, the movable contactor 70 is biased so that the first movable contact 72 can be contacted with the first fixed contact 64*a* of the terminal plate 63*a* and a predetermined contact pressure can be obtained.

However, since the movable contactor 70 is extended from the movable contact side terminal plate 63*c* in such a manner that it passes through the front portion of the slidable T-post member 26*c* of the slidable T-post 26, when the movable contactor 70 is pushed up ahead by the card member 26*c* of the slidable T-post 26, the first movable contact 72 is separated from thd first fixed contact 64*a* of the terminal plate 63*a*. In this case, the movable contactor 70, the movable contact point point 72 and the first fixed contact 64*a* compose one switch mechanism (delay switch mechanism).

The lead plate 65 is integrally extended from the front end portion of the movable contact side terminal plate 63*c*. The cutout 73*a* of the rocking member 73 is engaged with the rising portions 66*a* on both sides of the protruding portion 66 formed at the end of the lead plate 65. The rocking member 73 can be freely oscillated around this protruding portion 66. In accordance with the operation of the handle 90, the second movable contact 74 formed on the rear surface of the rocking member 73 is contacted with and separated from the second fixed contact 64*b* of the terminal plate 63*b*. A portion of the lead plate 65 is supported by the front surface of the frame 21 (shown in FIG. 5). Therefore, a load given to the lead plate 65 is received by the frame 21.

A portion of the terminal plate 63*a* in which the first fixed contact 64*a* is arranged is held by the cutout portion 21*d*

(shown in FIG. 6) formed in the frame 21, so that the terminal plate 63*a* can be positioned. The movable contactor 70 is moved in a space of the cutout portion 21*e* formed in the frame 21, and the first movable contact 72 is contacted with and separated from the first fixed contact 64*a*.

In this connection, a light emitting element 77 (shown in FIG. 4) such as a neon glow lamp is connected between the terminal plate 63*a* and the movable contact side terminal plate 63*c*. Accordingly, this light emitting element 77 is turned on under the condition that the first movable contact 72 is not contacted with the first fixed contact 64*a*. The light emitting element 77 is arranged at a position opposed to the light transmitting window 91 of the handle 90, so that light can be irradiated outside through the light transmitting member 92. Therefore, when the delay switch of this embodiment is used, the position of the case 1 can be made sure by the light emitted from the light emitting element 77 even in the dark at night.

Figure 3:
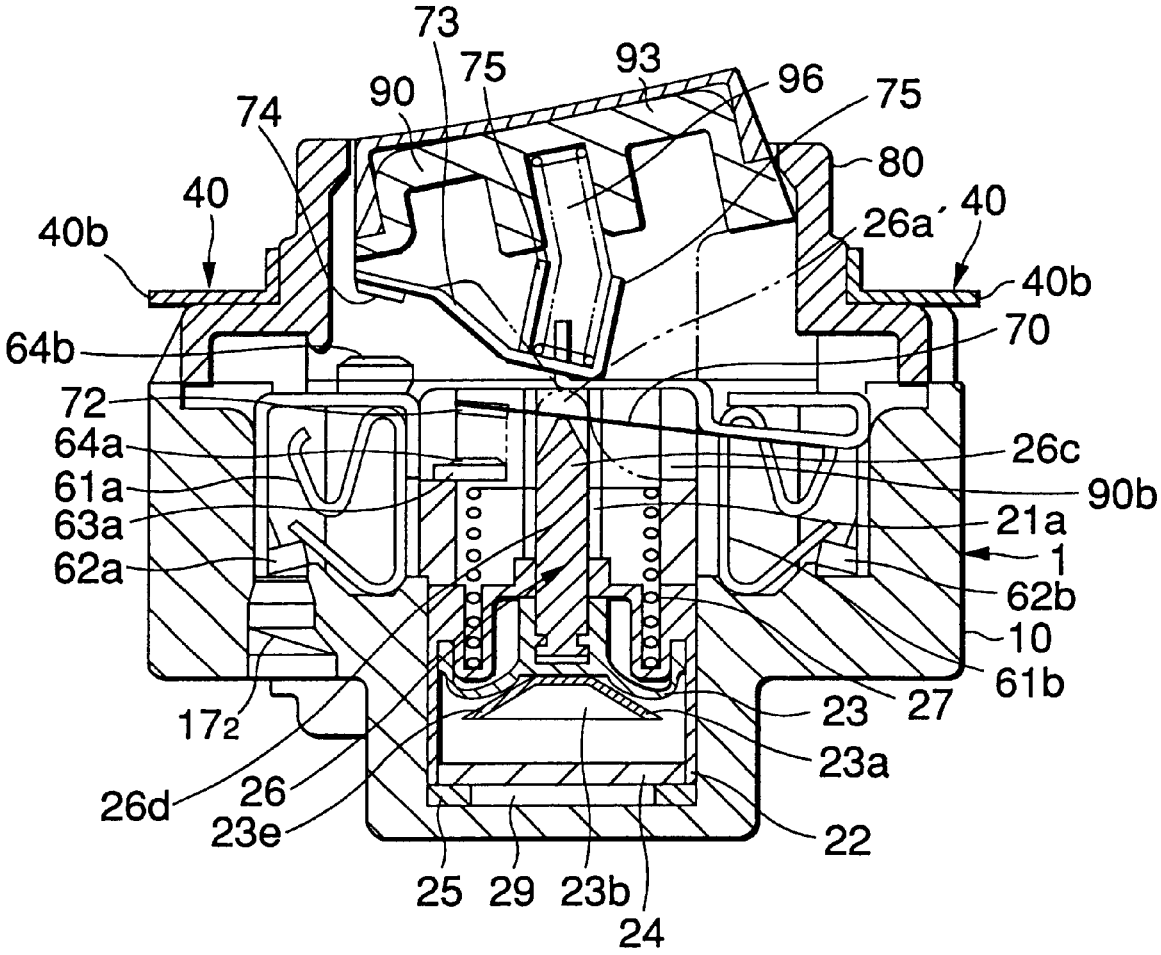
FIG. 3 is a cross-sectional view showing the above embodiment a state in which the delay switch is turned off.
Figure 11A:
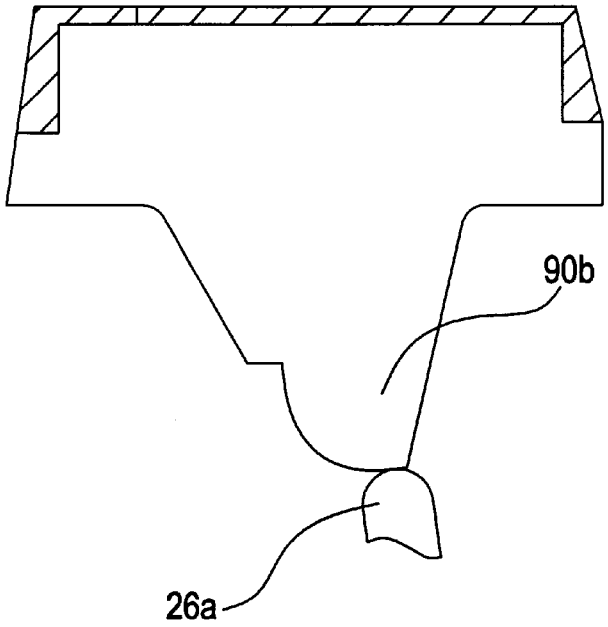
FIG. 11(*a*) and FIG. 11(*b*) are diagramatical views of the triangular cam and the pushing portion of the slidable T-post, in which the delay switch is turned on and off, respectively, according to the above embodiment
Figure 11B:
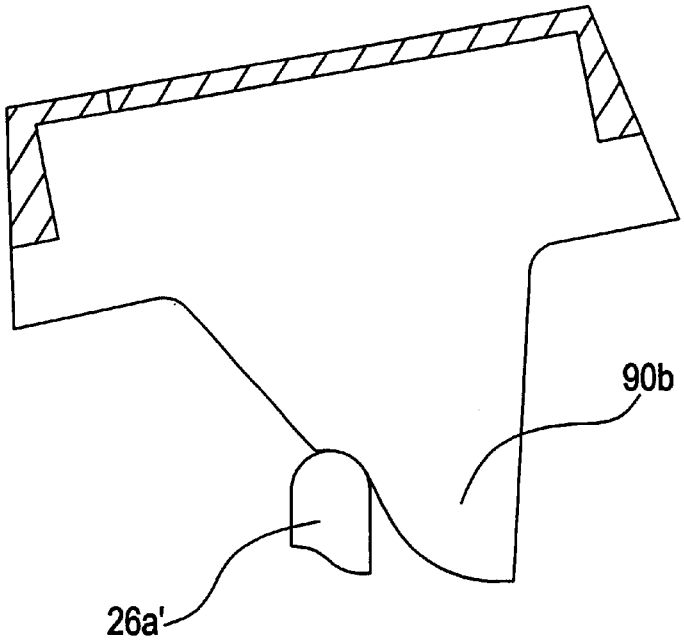

FIG. 3 is a view showing a state of the delay switch of this embodiment which has been turned off. When the handle 90, which is the operating section, is turned on in the above state, the compression spring 96 is inclined in the opposite direction. Therefore, as shown in FIG. 1(*b*), the second movable contact 74 arranged in the locking member 73 is contacted with the second fixed contact 64*b* of the terminal plate 63*b*, so that this electrical path is turned on, and at the same time when the cam 90*b* is rotated, an end portion of the cam 90*b* pushes the portion 26*a*' to be pushed of the slidable T-post 26, and the slidable T-post 26 is moved while it resists the pushing force of the return spring 27, that is, the slidable T-post 26 is pushed down as shown in FIGS. 3 and 11(*a*). Therefore, the first movable contact 72 of the movable contactor 70 comes into contact with the first fixed contact 64*a* of the terminal plate 63*a*, so that this electrical path is turned on. When the slidable T-post 26 is moved, the suction cup 23*b* is pushed down to a position at which the suction cup 23*b* comes into contact with the body 24, and the suction cup 23*b* holds the body 24 by the holding force of the suction cup 23*b*. Therefore, when the slidable T-post 26 is pushed down, the suction cup 23*b* is held by the body 24 by the holding force, that is, the suction cup 23*b* is kept in the condition shown in FIG. 1.

Figure 2:
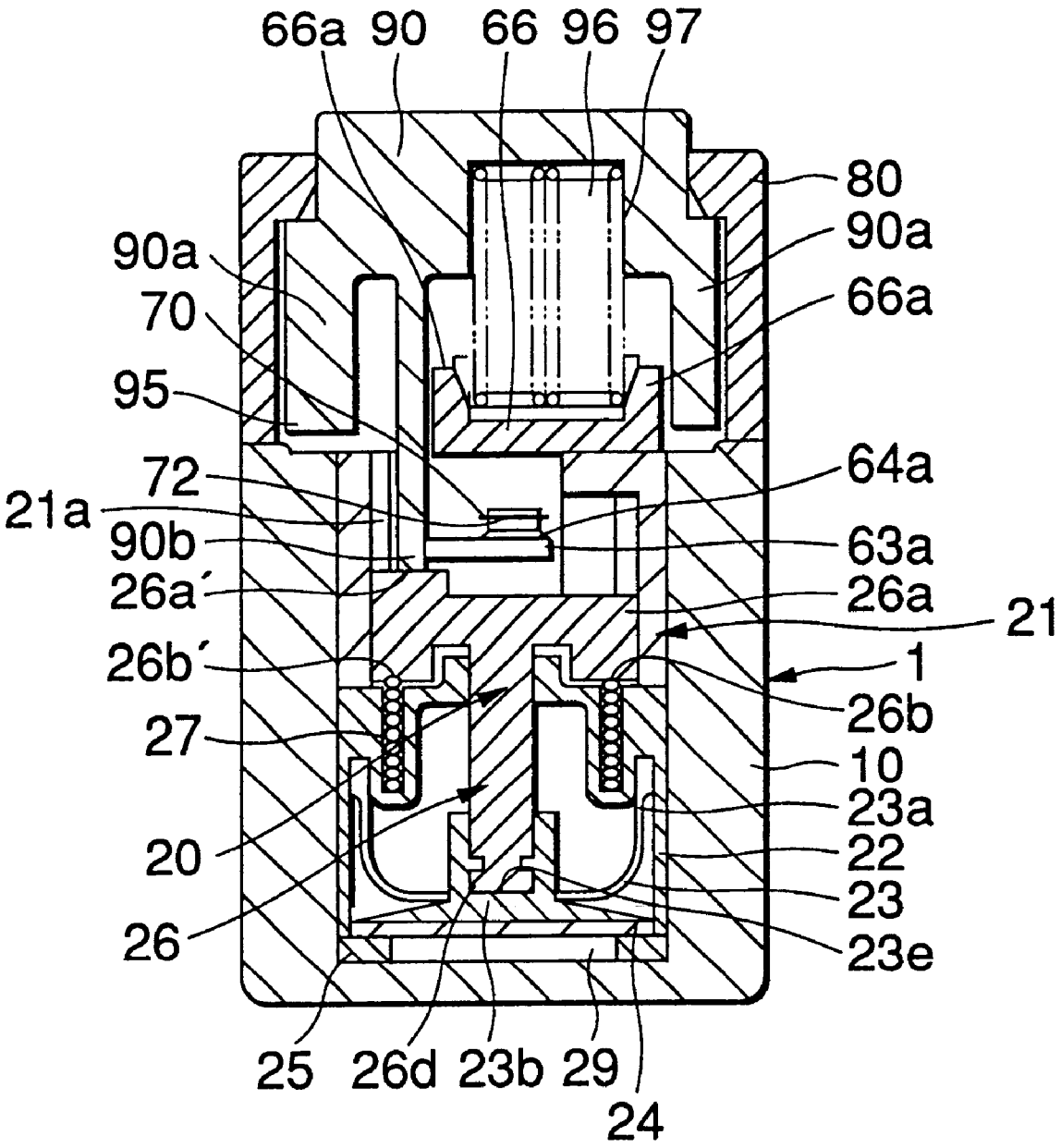

On the other hand, FIGS. 1 and 2 show a state of the delay switch of this embodiment which is turned on. When the handle 90 is turned off in the above state, that is, when the handle 90 is set in the releasing operation, the cam 90*b* is rotated, and the end portion of the cam 90*b* is moved from the end of the portion 26' to be pushed off and to the side of the slidable T-post 26. See FIG. 11(*b*) When the handle 90 is set in the releasing operation, the compression spring 96 is inclined in the opposite direction. Therefore, as shown in FIG. 3, the second movable contact 74 arranged in the rocking member 73 is separated from the second fixed contact 64*b* of the terminal plate 63*b*. When the aforementioned delay time has elapsed after that, the slidable T-post 26 is moved ahead by the restoring force of the return spring 27, and the card member 26*c* pushes ahead the movable contactor 70. Therefore, the first movable contact 72 is separated from the first fixed contact 64*a*, and this electrical path is also turned off, that is, the switch mechanism is turned off. In other words, the delay switch is put into a state shown in FIG. 3.

In the delay switch of this embodiment, in the releasing operation conducted by the handle 90, there is caused a delay time from the releasing operation to the separation of the suction cup 23*b* from the body 24. Accordingly, unlike the conventional delay switch, no gears are required. Therefore, compared with the delay switch having a conventional delay unit, the structure of the delay switch of this embodiment is simple and the reliability is high, and the manufacturing cost is low, and further the noise can be decreased.

When the delay switch of this embodiment is used for the switching operation of a ventilating fan and an illuminating light arranged in a toilet, since the terminals $\mathbf{60}_3$ and $\mathbf{60}_4$ have the movable contact side terminal plate 63*c* in common, the illuminating light may be connected to the terminal $\mathbf{60}_2$, and the ventilating fan may be connected to the terminal $\mathbf{60}_1$. In this case, when the handle 90 is turned on, that is, when the handle 90 is operated to be set, the illuminating light is put on, and at the same time, the ventilating fan is driven. When the handle 90 is turned off, that is, when the handle is operated to be released, only the illuminating light is immediately put out, and the ventilating fan is stopped after a delay time has passed. Accordingly, it is possible to avoid inconvenience caused when the ventilating fan is immediately stopped, and further it is possible to prevent a person from forgetting to stop the ventilating fan. In this connection, this delay switch can be used in various places except for a toilet. The delay time may be appropriately set in accordance with the environment in which the delay switch is used and the object of using the delay switch.

In order to accomplish the above object, the present invention is to provide a delay switch comprising: an operating section; a suction cup operated being linked with the setting operation conducted by the operating section; a slidable T-post to open and close the switching mechanism being linked with the suction cup; a body to hold the suction cup after the suction cup has been moved; a return spring to give a force to the suction cup in a direction so that the suction cup can be separated from the body; and a terminal with which the switching mechanism is electrically connected, wherein a delay time is caused from the time at which releasing operation is conducted in the operating section to the time at which the suction cup is separated from the body, in accordance with a balance between the holding force of the suction cup to the body and the spring force of the return spring. Since the delay time is determined by a balance between the holding force of the suction cup to the body and the spring force of the return spring, no gears are required unlike the conventional delay unit, and structure of this delay switch is simpler than that of the delay switch having the conventional delay unit, and further the reliability is high and the manufacturing cost can be reduced and the noise can be decreased. Unlike the conventional delay switch, no gears are required in the delay switch. Therefore, the operation conducted in the operating section is smooth.

According to the present invention, a delay unit is composed of the suction cup, body, slidable T-post and return spring. Accordingly, compared with the conventional delay switch, the manufacturing cost of the delay unit can be reduced, and further the delay switch can be miniaturized. Furthermore, the intensity of noise generated by the delay switch ca be decreased.

According to the present invention, a case for the element in which at least the suction cup and the body are accommodated. Therefore, it is possible to prevent foreign objects such as dust from intruding into a space between the suction cup and the body, by the case for the element. Accordingly, the suction cup can be stably forced to the body by the holding force, and the delay time can be kept substantially constant.

According to the present invention, a dust protection means for separating the suction cup from the outside of the case for the element. Therefore, it is possible to prevent foreign objects such as dust from intruding into a space between the suction cup and the body. Accordingly, the suction cup can be stably forced to the body by the holding force, and the delay time can be kept substantially constant.

According to the present invention, the dust protection means is an elastic suction cup cover accommodated in the case for the element and linked with the slidable T-post. Since the structure of the dust protection means is simple, the motion of the suction cup is not obstructed by the dust protection means, and it is possible to prevent foreign objects such as dust from intruding into a space between the suction cup and the body.

According to the present invention, wherein the body is a porous body. Accordingly, the delay time can be easily set. Further, compared with an porous body, the coefficient of air transmission of the porous body is seldom affected by the temperature. Therefore, a variation of the delay time caused by a variation of the ambient temperature can be reduced, and the delay time can be controlled with high accuracy.

According to the present invention, the slidable T-post is composed of a slidable T-post member to open and close the switch mechanism and a drive shaft member to hold the suction cup by the body, and the card member and drive shaft member are simultaneously formed. Therefore, the number of parts can be reduced and the manufacturing process ca be simplified. Accordingly, the manufacturing cost can be decreased.

According to the present invention, the slidable T-post is composed of a slidable T-post member to open and close the switch mechanism and a drive shaft member to hold the suction cup by the body, and the slidable T-post member and the drive shaft member are combined with each other. Therefore, the profile of the slidable T-post can be easily controlled.

According to the present invention, a case in which at least the suction cup, body, slidable T-post and return spring are accommodated, wherein this case is composed by a size corresponding to one set of embedded type wiring accessory, the unit size of which is determined so that three sets of wiring accessories can be attached at maximum in such a manner that the front surface of the case is exposed from an opening window of the attaching frame of the embedded type wiring accessories. Accordingly, it is possible to attach the delay switch to the attaching frame in the same manner as that of the embedded type wiring accessories such as a receptacle and a switch. Therefore, the attaching work can be performed easily.

According to the present invention, the terminal is composed of a quick-connecting type terminal structure including a terminal plate to which an electrical wire is connected, a lock spring to connect the electrical wire to the terminal plate with pressure, and a release button to bend the lock spring in the release direction so as to disconnect the electrical wire from the terminal plate. Therefore, compared with a screw type terminal structure, the attaching work can be conducted safely. Further, since the electrical wire can be easily and positively connected to the terminal, wiring can be conducted uniformly, and the labor and time can be saved in the attaching work.

The present invention is not limited by the embodiment described above.

Many modifications and variations of the present invention are possible in light of the above teachings. Therefore, within the scope of the appended claims, the present invention may be practiced otherwise than as specifically described.

What is claimed is:

1. A delay switch comprising:

an operating section; and a delay unit including:

a suction cup linked with said operating section;

a slidable T-post that is distinct from said operating section, said slidable T-post being slidably abutable to said operating section, and said slidable T-post cooperating with said suction cup and said operating section to open and close a switching mechanism;

a body to hold said suction cup with a holding force;

a return spring having a spring force urging said suction cup in a direction separating said suction cup from said body; and a terminal with which the switching mechanism is electrically connected, wherein said delay unit produces a delay time, said delay time beginning when said spring force of said return spring urges said suction cup in said direction, said delay time concluding when said holding force of said suction cup to said body is overcome by said spring force of said return spring; and wherein said delay unit includes a case in which at least said suction cup and said body are accommodated; and wherein said delay unit further includes a dust protection member movable with said slidable T-post and which separates said suction cup from an inside surface of said case.

2. A delay switch according to claim 1, wherein said dust protection member includes an elastic suction cup cover accommodated in said case and linked with said slidable T-post.

3. A delay switch according to claim 1, wherein said body is made of a porous material.

4. A delay switch according to claim 1, wherein said slidable T-post is defined by a slidable T-post member to open and close said switch mechanism and a drive shaft member to hold said suction cup, and said slidable T-post member is integral to said drive shaft member.

5. A delay switch according to claim 1, wherein said slidable T-post is defined by a slidable T-post member to open and close said switch mechanism and a drive shaft member to hold said suction cup.

6. A delay unit being operatively combined with an operating section, said delay unit comprising:

a suction cup;

a slidable T-post that is distinct from said operating section, said slidable T-post being slidably abutable to said operating section, and said slidable T-post cooperating with said suction cup and said operating section;

a body holding said suction cup with a holding force;

a return spring having a spring force urging said suction cup in a direction separating said suction cup from said body;

a case accommodating at least said suction cup and said body, wherein said delay unit produces a predetermined delay time beginning when said spring force of said return spring urges said suction cup in said direction, said delay time concluding when said holding force of the suction cup to said body is overcome by said spring force of said return spring; and wherein said delay unit includes a dust protection member movable with said slidable T-post and which separates said suction cup from an inside surface of said case.

7. A delay switch according to claim 6, wherein said dust protection member includes an elastic suction cup cover accommodated in the case and linked with the slidable T-post.

8. A delay switch according to claim 6, wherein the body is made of a porous material.

9. A delay switch according to claim 6, wherein said slidable T-post is defined by a slidable T-post member and a drive shaft member to hold said suction cup, and said slidable T-post member is integral to said drive shaft member.

10. A delay switch according to claim 6, wherein the slidable T-post is defined by a slidable T-post member and a drive shaft member to hold said suction cup.

11. A delay device comprising:

a main body extending in a longitudinal direction, said main body including a delay unit accommodating section with ends aligned in said longitudinal direction, said main body further including terminal accommodating sections provided adjacent to said ends;

an operating unit including a cover member mounted onto said main body, said cover member having an opening and a handle mounted in said opening;

a delay unit located in said delay unit accommodating section, said delay unit including:

a suction cup;

a slidable T-post that is distinct from said operating unit, said slidable T-post being slidably abutable to said operating unit, and said slidable T-post cooperating with said suction cup and said operating unit;

a body holding said suction cup with a holding force;

a return spring having a spring force urging said suction cup in a direction separating said suction cup from said body; and a case accommodating at least said suction cup and said body; and a switch mechanism cooperating with said operating unit and said delay unit, said delay unit producing a predetermined delay time beginning when said spring force of said return spring urges said suction cup in said direction, said delay time concluding when said holding force of the suction cup to said body is overcome by said spring force of said return spring; and wherein said delay unit includes a dust protection member movable with said slidable T-post and which separates said suction cup from an inside surface of said case.

12. A delay switch according to claim 11, wherein said switch mechanism includes terminal plates, said terminal plates include a movable-contact side terminal plate and a first fixed terminal plate with a first fixed contactor, said movable-contact side terminal plate has a movable contactor with a first movable contactor contactable with said first fixed contactor, and wherein said movable-contact side terminal plate and said first fixed terminal plate are accommodated in said terminal accommodating sections, respectively.

13. A delay switch according to claim 12, wherein after said delay time is terminated, said first fixed contactor and said first movable contactor are separated.

14. A delay switch according to claim 12, wherein said terminal plates include a rocking member with a second movable contactor and a second fixed terminal plate with a second fixed contact contactable with said second movable contactor, and said second fixed terminal plate is accommodated in said terminal accommodating sections.

15. A delay switch as claimed in claim 14, wherein said second fixed contactor and said second movable contactor are separated at the beginning of said delay time.

16. A delay switch according to claim 11, wherein said dust protection member includes an elastic suction cup cover accommodated in the case and linked with the card.

17. A delay switch according to claim 11, wherein the body is made of a porous material.

18. A delay switch according to claim 11, wherein said slidable T-post is defined by a slidable T-post member to open and close said switch mechanism and a drive shaft member to hold said suction cup, and said slidable T-post member is integral to said drive shaft member.

19. A delay switch according to claim 11, wherein the slidable T-post is defined by a slidable T-post member to open and close said switch mechanism and a drive shaft member to hold said suction cup.

* * * * *